United States Patent [19]

Rivette, Jr. et al.

[11] Patent Number: 4,726,796

[45] Date of Patent: Feb. 23, 1988

[54] DRIVING AND STEERING MECHANISM FOR BOATS

[76] Inventors: W. John Rivette, Jr., 12103 Cline Dr., Baker, La. 70714; Thomas G. Bourgeois, Rte. 8, Box 444, Gonzalas, La. 70737; Samuel P. Calamia, Jr., 13830 Spreading Oaks Dr., Baton Rouge, La. 70818

[21] Appl. No.: 854,181

[22] Filed: Apr. 21, 1986

[51] Int. Cl.[4] ..... B63H 5/12

[52] U.S. Cl. ..... 440/55; 440/57; 440/83

[58] Field of Search ..... 440/49, 53, 55–57, 440/63–65, 75, 83; 114/144 R; 24/480 B

[56] References Cited

U.S. PATENT DOCUMENTS

| | | | |
|---|---|---|---|
| 941,827 | 11/1909 | Trouche | 440/53 |
| 968,128 | 8/1910 | Cole . | |
| 1,953,599 | 4/1934 | Grimes | 440/53 |
| 2,096,223 | 10/1937 | Chandler et al. | 440/63 |
| 2,475,115 | 7/1949 | Van Eaton . | |
| 3,187,520 | 6/1965 | Rzeppa . | |
| 3,430,603 | 3/1969 | Parish | 440/63 |
| 3,489,120 | 1/1970 | Strang . | |
| 3,752,111 | 8/1973 | Meynier | 440/56 |
| 3,841,257 | 10/1974 | Strang . | |

OTHER PUBLICATIONS

Gator Kraff, 2–Page Brochure (undated) of Ernest--Blanchard Co.

Sports Afield, Sep. 1982, p. 50.

GO–DEVIL, a 1–Page Brochure with attached Price List effective Aug. 1, 1985.

CON–Vel ® Constant Velocity Joints, a 24–Page (plus covers) Brochure, apparently dated 12/81, by Dana Corporation.

A 1–Page Advertisement by Kaama Marine Engineering, Inc., appearing in "Boating" magazine (date unknown).

Boating, Jul. 1985, pp. 65 and 66.

An Advertisement of TEE MUD BOAT by R&R Boat Sales appearing in Page 48 of an unknown and undated publication.

The Integrated Concept, a 4–Page Brochure by Parrish Power Products, Inc., (not clearly dated, but may be 1978).

MUD–King–a 2–Page undated Product Bulletin by the Mud–King Division of L&L Industries, Inc.

*Primary Examiner*—Jeffrey V. Nase
*Assistant Examiner*—Stephen P. Avila
*Attorney, Agent, or Firm*—John F. Sieberth

[57] ABSTRACT

The mechanism comprises, in combination, a main power shaft, a propeller shaft, a housing for the propeller shaft, a disc-type constant velocity joint (Rzeppa joint) operatively connecting the main power shaft and the propeller shaft, and a tillar arm operatively connected to the housing of the propeller shaft. The Rzeppa joint enables the axial angular displacemnt of the propeller shaft relative to the power shaft to be altered in all directions. Thus if the boat encounters a submerged obstacle, the propeller shaft and its housing can automatically ride over the obstacle and avoid damage or entanglement. Preferably the system also includes a latch and stop assembly that enables the operator to pre-set the vertical angular displacement of the propeller shaft relative to the power shaft in various positions, e.g., (1) uplock (for overland transport and starting). (2) shallow drive (for travelling through swamps where the water is only a few inches deep). (3) normal running (where the propeller is somewhat more deeply immersed in the water), and (4) full depth. In positions (2) and (3) the propeller shaft can be moved laterally and upwardly but not downwardly to the next lower operating position unless a release on the tillar arm is actuated by the operator. A novel hollow funnel-shaped coupling device especially adapted for connecting the disc-type constant velocity joint to the rotatable power shaft is also described. The coupling device features a unique way of lubricating the constant velocity joint from the interior of the coupling device. Also described is a novel latch and stop mechanism additionally adapted to serve as a swivel joint.

25 Claims, 6 Drawing Figures

DRIVING AND STEERING MECHANISM FOR BOATS

TECHNICAL FIELD

This invention relates to a novel and highly efficient mechanical system for steering and propelling power driven boats.

BACKGROUND

Generally speaking, there are two widely divergent types of service conditions under which a boat may be operated. One type of service involves operation in relatively deep water (lakes, rivers, etc.) where rarely, if ever, is contact with submerged objects of concern. The other type of service is largely but not exclusively encountered in swampy regions such as exist in Southern Louisiana, Southern Florida, and elsewhere. In this type of service the water is oftentimes extremely shallow, sometimes not more than few inches deep. And such shallow waters are often muddy, clogged with vegetation, and replete with submerged obstacles such as tree logs or branches, mud bars, and the like. For such service flat bottom boats are normally employed.

Heretofore two different approaches have been taken in providing propulsion and steering systems for use under these severe shallow water service conditions. One approach involves mounting the engine in a tilted position within the flat bottom boat so that the power and propeller shaft extends downwardly and rearwardly through the bottom of the boat where it is held in place under the rear of the boat at a relatively shallow depth by a strut bearing positioned in front of the propeller. The rudder is separately mounted on the transom at the rear of the boat. The other approach involves use of a highly elongated propeller shaft (e.g., 5 or 6 feet in length) which is coupled to the engine drive shaft by means of a standard universal joint. With this system the engine is mounted over the transom of the boat and because of the long propeller shaft used, the entire unit including the engine pivots when the shaft or a shoe on the shaft encounters a submerged obstacle.

THE INVENTION

In accordance with this invention a new mechanical system for propelling and steering power driven boats is provided. These systems are extremely versatile as they can be used to drive and steer boats in relatively deep water or in the extremely shallow waters such as are encountered in swamps, bayous and savannahs. The systems are durable, simple in design, compact, easy to operate, and highly reliable during use even under the most severe shallow water conditions of the type referred to above. What's more, they are relatively inexpensive, and require very little maintenance.

The features and advantages of this invention are accomplished by providing in combination, a main power shaft, a propeller shaft, a housing for the propeller shaft, a disc-type constant velocity joint operatively connecting the main power shaft and the propeller shaft, and a tillar arm operatively connected to the housing of the propeller shaft for adjusting the axial displacement of the propeller shaft relative to the axis of the main power shaft. Preferably the mechanism further includes latch and stop catch means for adjusting the vertical angle of displacement between the propeller shaft and the main power shaft. As will be apparent hereinafter, in a particularly preferred mode of construction such latch and stop means are further characterized in that they enable the propeller shaft, aligned in preselected vertical angular displacement relative to the power shaft, to be moved laterally for steering purposes while permitting the propeller shaft to be vertically displaced upwardly as soon as it comes in contact with a submerged obstacle such as a tree log or stump, mud bar, or the like.

In still another embodiment of this invention the latch and stop means are further characterized in that (a) they enable the propeller shaft to be aligned in a plurality of preselected vertical angular displacement positions relative to the power shaft, in that (b) they enable the propeller shaft, aligned in at least one of the preselected vertical angular displacement positions relative to the power shaft, to be moved laterally and upwardly but not downwardly from said preselected vertical angular displacement, and in that (c) they include a manually actuatable release enabling the propeller shaft to be moved upwardly or downwarly within the range of said preseleced vertical angular displacement positions.

Yet another embodiment of this invention is the provision of a novel hollow funnel-shaped coupling device especially adapted for connecting the disc-type constant velocity joint to the rotatable power shaft. The coupling device also features a unique way of lubricating the constant velocity joint from the interior.

These and other embodiments and characteristics of this invention will be still further apparent from the ensuing description, appended claims, and accompanying Drawings.

BRIEF SUMMARY OF THE DRAWINGS

In the Drawings, like numerals represent like parts among the several views.

DESCRIPTION OF PREFERRED EMBODIMENTS

Figure 1:
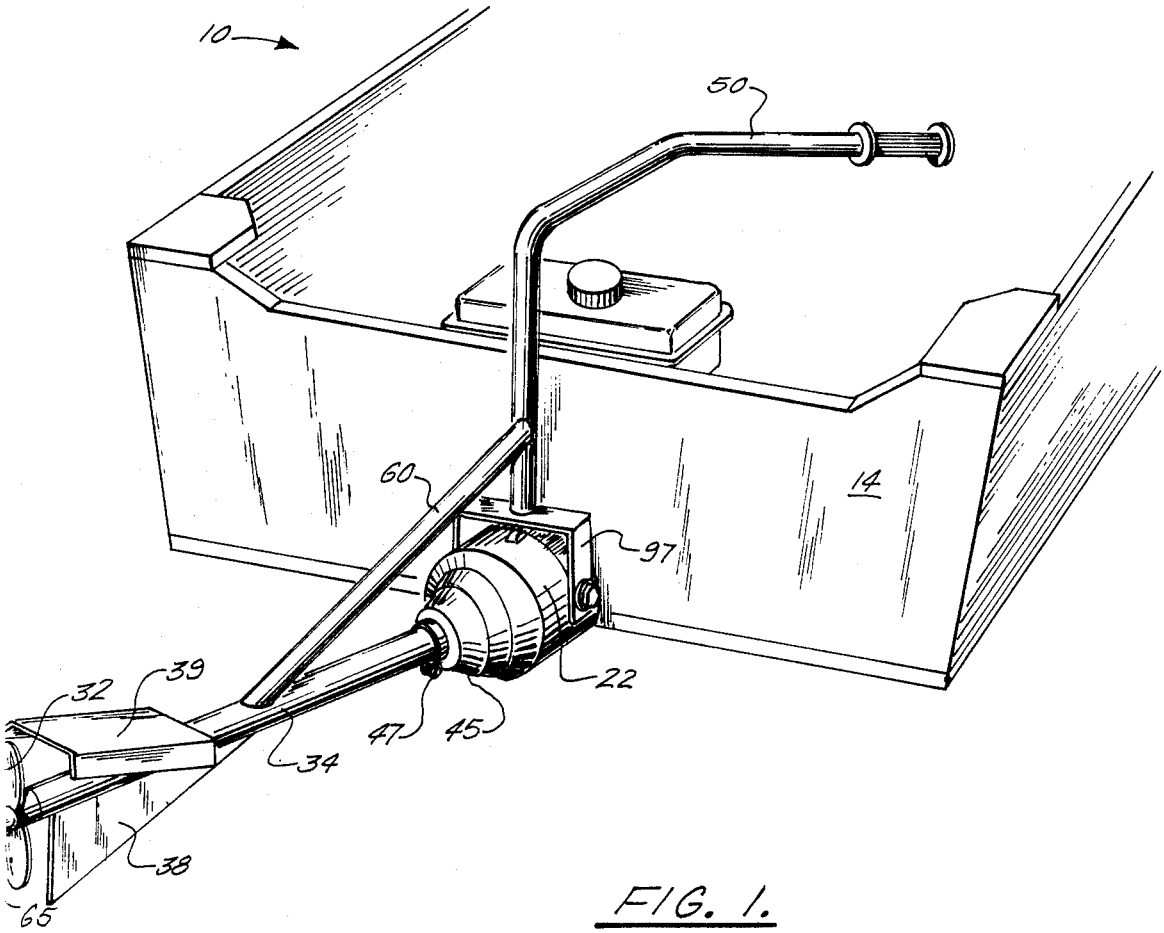
FIG. 1 is a view in perspective of the back end of a flat bottom boat equipped with a preferred form of driving and steering mechanism of this invention.

In the preferred form depicted, the mechanism mounted on boat 10 comprises main power shaft 20, propeller shaft 30, propeller 32, guide tube 34, disc-type constant velocity joint 40 interposed between and connecting shafts 20 and 30, tillar arm 50, and connector arm 60 extending between tillar arm 50 and guide tube 34. Propeller 32 is tightly but detachably secured to propeller shaft 30 by means of propeller nut 65. Tube 34 serves as a housing for propeller shaft 30. Shaft 30 is rotatably supported within tube 34 by means of forward shaft bushing 31 and rearward shaft bushing 33. Shaft seals and shaft packing (not shown) are preferably inserted to the rear of bushing 33 to provide a liquid tight seal between the back end of tube 34 and shaft 30. Power is supplied to shaft 20 by engine or motor 12. Shaft 20 is encased in transom tube 22 which extends through the transom 14 of the boat. Constant velocity joint 40 is encased within transom tube 22 and flexible boot 45, and the interior of transom tube 22 and boot 45 is filled to an appropriate level with lubricating oil (not shown) which is added via filler tube 25. A metal strap-type clamp (not shown) of appropriate diameter is positioned and tightened around the exterior of boot 45 to seal the forward portion of boot 45 against transom tube 22, and another such clamp 47 of smaller diameter is positioned and tightened around the exterior of the back end portion of boot 45 to seal it against a forward portion of guide tube 34. These clamps not only secure the boot in place, but prevent the leakage of oil from the boot and the intake of water into the boot. The filler tube cap (not shown) is preferably fitted with a dip stick for measuring the level of oil in this combination power transmission and steering system.

Secured to guide tube 34 are skeg 38 and antiventilation plate 39. It will be noted that skeg 38 is in the shape of an inverted inclined plane to enable the skeg to ride over submerged obstacles. In so doing, skeg 38 elevates the entire assembly comprising guide tube 34, propeller shaft 30, and propeller 32 and thereby keeps the assembly from striking or becoming embedded in the obstacle. And, constant velocity joint 40 makes this upward pivoting movement possible—the position of the engine or motor and its power shaft are not changed. Forward skeg 23 is mounted at the base of transom tube 22.

Tillar arm 50 is of tubular contruction and is swivelly mounted on transom tube 22 by means of pivot bracket or arm 97 (which pivots around a horizontal axis) and pivot pin 54 (around the axis of which the tillar arm may be rotated) so that the tillar arm can be moved upwardly and downwardly as well as from side to side. Catch pin 51 is concentrically aligned with and slidably mounted within pivot pin 54 which in turn is mounted on pivot arm 97 and disposed within the lower end portion of tillar arm 50. While not essential, it is preferred to position a vertical cylindrical bushing (not shown) coaxially between pivot pin 54 and the lower portion of tillar arm 50, the bushing extending vertically along substantially the entire length of the pivot pin. The lower end portion of catch pin 51 is positioned and adapted to engage the down stop catch 70. The upper end portion of catch pin 51 has a cylindrical recess 52 into which is fitted catch pin spring 53 which is maintained under compression by a stop 99 or other restraining means within pivot pin 54. In this way spring 53 tends to apply a continuous downward force against catch pin 51 to keep it in engagement with catch 70.

Figure 4:
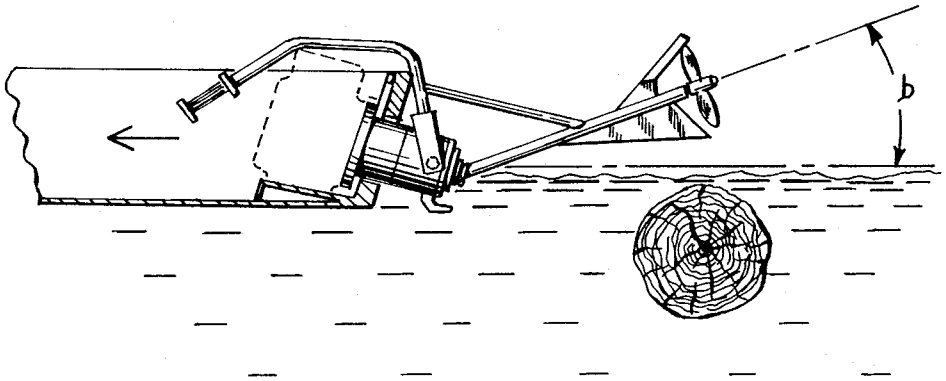
FIG. 4 is a side view as in FIG. 3 showing the propeller shaft upwardly displaced relative to the main power shaft to avoid contact between the submerged obstruction and the propeller shaft.

Attached to catch pin 51 is catch pin cable 55 which extends along the interior of pivot pin 54 and along the interior of tillar arm 50 to down stop latch or release 56 in proximity to handle grip 57. Latch or release 56 in the form depicted is composed of a cylinder 58 rotatable within the tillar arm and having a latch pin 59 extending through a notched slot 63 in the tillar arm, the notched slot having a plurality of notches to accommodate pin 59 at different locations along the length of the tillar arm. Cable 55 is connected to cylinder 58 so that when pin 59 is moved out of a notch and a manual pulling force toward the handle grip 57 is applied to pin 59 by the boat operator, the cable applies the pulling force to catch pin 51 in an upward direction thereby overcoming the downward force exerted by spring 53. As a consequence of this upward pulling force, catch pin 51 can be disengaged from the down stop catch 70 so that the angle of displacement of propeller shaft 30 relative to power shaft 20 can be adjusted by moving tillar arm upwardly or downwardly to a position in which catch pin 51 will engage a different portion of down stop catch 70. At this point pin 59 is moved into the appropriate notch and the pulling force on release 56 is released so that spring 53 forces catch pin 51 into the desired stop position on down stop catch 70. For example by moving catch pin 51 in the manner described from its position shown in FIG. 6 to the next adjacent segment to the right on catch 70, the vertical alignment between propeller shaft 30 to power shaft 20 can be changed from a position in which the propeller is in a very shallow depth in the water to a position in which the propeller shaft extends more deeply in the water, an operation which would normally be carried out when proceeding from very shallow water to somewhat deeper water. Conversely, by moving catch pin 51 from its position shown in FIG. 6 to the next adjacent segment to the left on catch 70, the vertical alignment between propeller shaft 30 to power shaft 20 can be changed from the shallow operating position to a position in which the propeller shaft extends upwardly above the surface of the water (as in FIG. 4).

A feature of the preferred catch pin-down stop catch mechanism just described is is its automatic self-adjustability in the event the propeller shaft encounters a submerged obstruction. More particularly, if a boat, travelling in shallow water with its propeller shaft aligned with the power shaft (as in FIG. 3) passes over a submerged object that is impacted by skeg 38, the preferred catch pin-down stop catch mechanism described above does not prevent upward pivoting of the propeller shaft and its housing. Thus the propeller shaft and its housing are free to pivot upwardly and thereby ride over the top of the submerged object. Once the object is cleared, the catch pin-down stop catch mechanism of the type described allows the propeller shaft 30 to rotate downwardly to its original depth, but no further (unless the operator uses the release 56 to change the setting of the vertical angular displacement of the propeller shaft relative to the power shaft).

It will also seen that the preferred catch pin-down stop catch mechanism of the device depicted in the Drawings enables the propeller shaft to be aligned in a plurality of preselected vertical angular displacement positions relative to the power shaft. In the form depicted in FIG. 6 there are four such positions, namely:

(1) an uplock position in which the propeller shaft extends upwardly above the horizontal (note FIG. 2), (2) a shallow drive position wherein the propeller shaft is displaced upwardly from the axis of the power shaft so that the propeller is immersed slightly below the surface of the water;

(3) a normal running position in which the propeller shaft and power shaft are linearly aligned (when viewed from the side—note FIG. 3) so that the propeller is immersed somewhat more deeply below the surface of the water to an optimum running depth for the boat in use; and (4) a full depth position in which the propeller shaft extends downwardly from the power shaft even more deeply into the water.

In each of positions (2) and (3) the propeller shaft can be moved laterally and upwardly by tillar arm 50, but stop 52 prevents its downward movement from that preselected position. However by manually actuating release 56, the position of the propeller shaft relative to the the power shaft can be readily adjusted from one position to another. Thus when transporting the boat overland and when starting the motor or engine, the system is normally in the uplock position. Once the motor or engine has been started, the system is adjusted by means of the release and tillar arm to the position desired for the situation at hand. This adjustability feature of this invention not only enables the operator to operate the boat in various types of service (shallow water, deep water, etc.) but it can be used to overcome severe obstacles. For example, if during operation in swampy or marshy terrain the boat becomes hung up on a stationary submerged obstacle, the full depth position can be used to lift the back of the boat upwardly over and off of the obstacle.

One of the key features of the mechanisms of this invention, is the coupling together of power shaft 20 and propeller shaft 30 by means of disc-type constant velocity joint 40. Constant velocity joint 40 transmits rotary motion to shaft 30 via hardened steel balls 42 rolling in a grooved cage 44. Such joints—often referred to as Rzeppa constant velocity joints—are fully described for example in Rzeppa U.S. Pat. No. 3,187,520 (all disclosure of which is incorporated herein by reference) and are available on the open market from different suppliers. They are designed for use in operating equipment in which the shafts are misaligned and so far as is known, constant velocity joints of this type have never been used in a system for driving and steering a boat. Particularly good results in the practice of this invention has been achieved using a small CONVEL disc-type constant velocity joint available from Dana Corporation, Detroit, Mich., viz., model number R2-98-41X.

Figure 2:
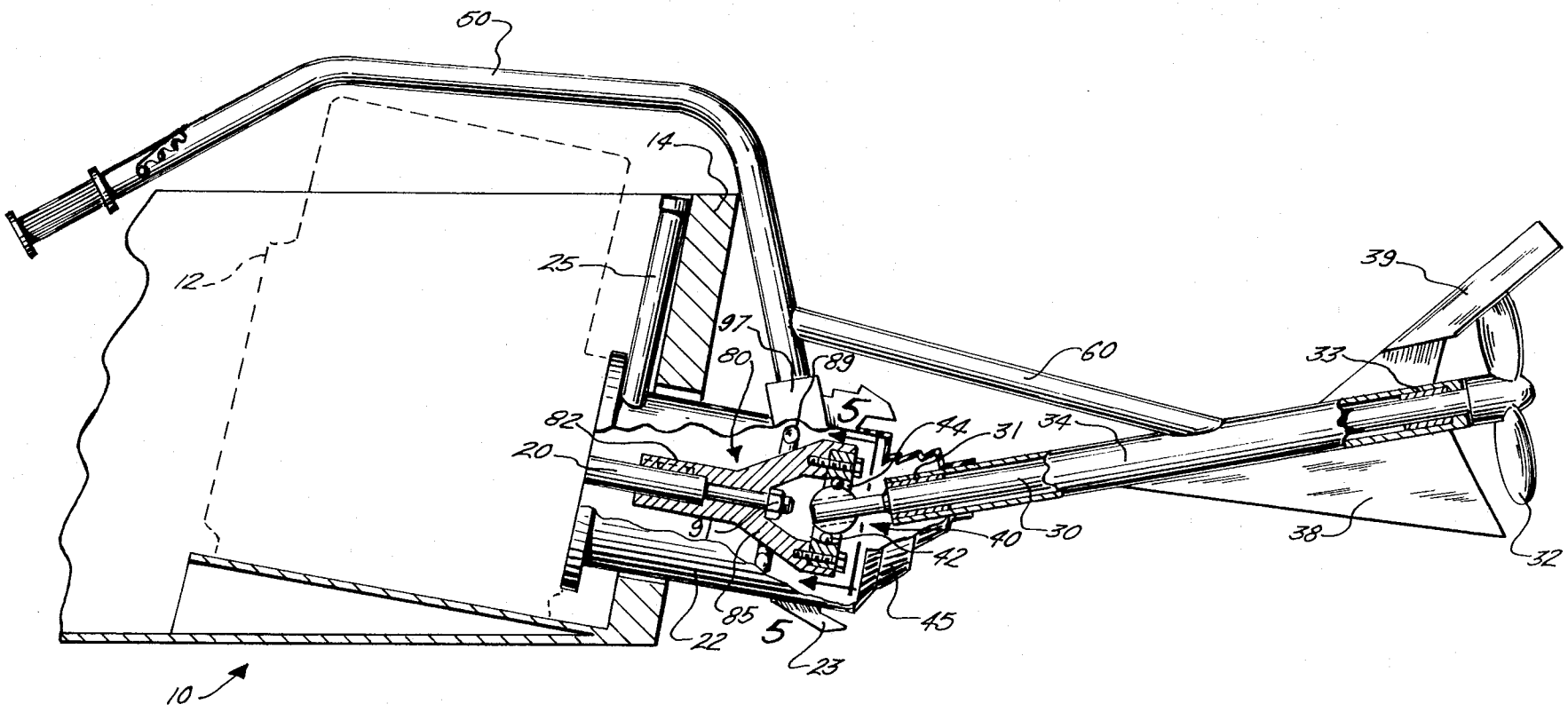
FIG. 2 is a side view—partly broken away and partly in section—of the mechanism of FIG. 1.
Figure 5:
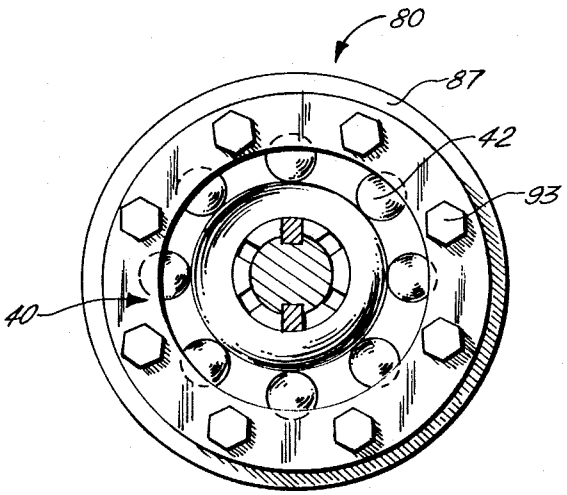
FIG. 5 is a view, taken along line 5,5 of FIG. 2, of the disc-type constant velocity joint attached to a coupling device of this invention.

Another feature of this invention, best seen in FIGS. 2 and 5 is the preferred manner by which the disc-type constant velocity joint 40 is secured to the power shaft 20. For this purpose, a coupling device 80 is utilized which comprises a hollow funnel-shaped body composed of a cylindrical tubular section 82, an outwardly tapering conical section 85 which extends from tubular section 82, a wide ring-shaped mouth section 87 which extends from conical section 85, and a plurality of hollow tubular scoops or flutes 89 which extend through the walls and outwardly from conical section 85. Tubular section 82 is adapted to attachably receive an end portion of power shaft 20. While other modes of attachment may be employed, in the preferred form depicted tubular section 82 has an outer end portion with a bore to slidably receive the end portion of shaft 20 and an inner end portion with a bore of smaller diameter to coaxially accommodate means for threadably securing the device to the power shaft, such as a bolt or a machine screw and nut 91. The portion of the funnel-shaped body forming ring-shaped mouth section 87 has an annular recess adapted to attachably receive the constant velocity joint 40 which is secured to the body by means of bolts or machine screws 93. Flutes 89 are adapted, when the device is rotated by the power shaft, to pick up lubricating oil from the interior of transom tube 22 and transmit lubricating oil into the interior of conical section 85. The centrifugal force created by the rotation causes lubricating oil to travel along the interior of the conical section and lubricate the constant velocity joint 40 from the interior of the coupling device. Operation at all operating speeds (usually about 900 to about 3600 rpm) creates a centrifugal force sufficient to cause the lubricating oil to spew through the rotating constant velocity joint.

Figure 6:
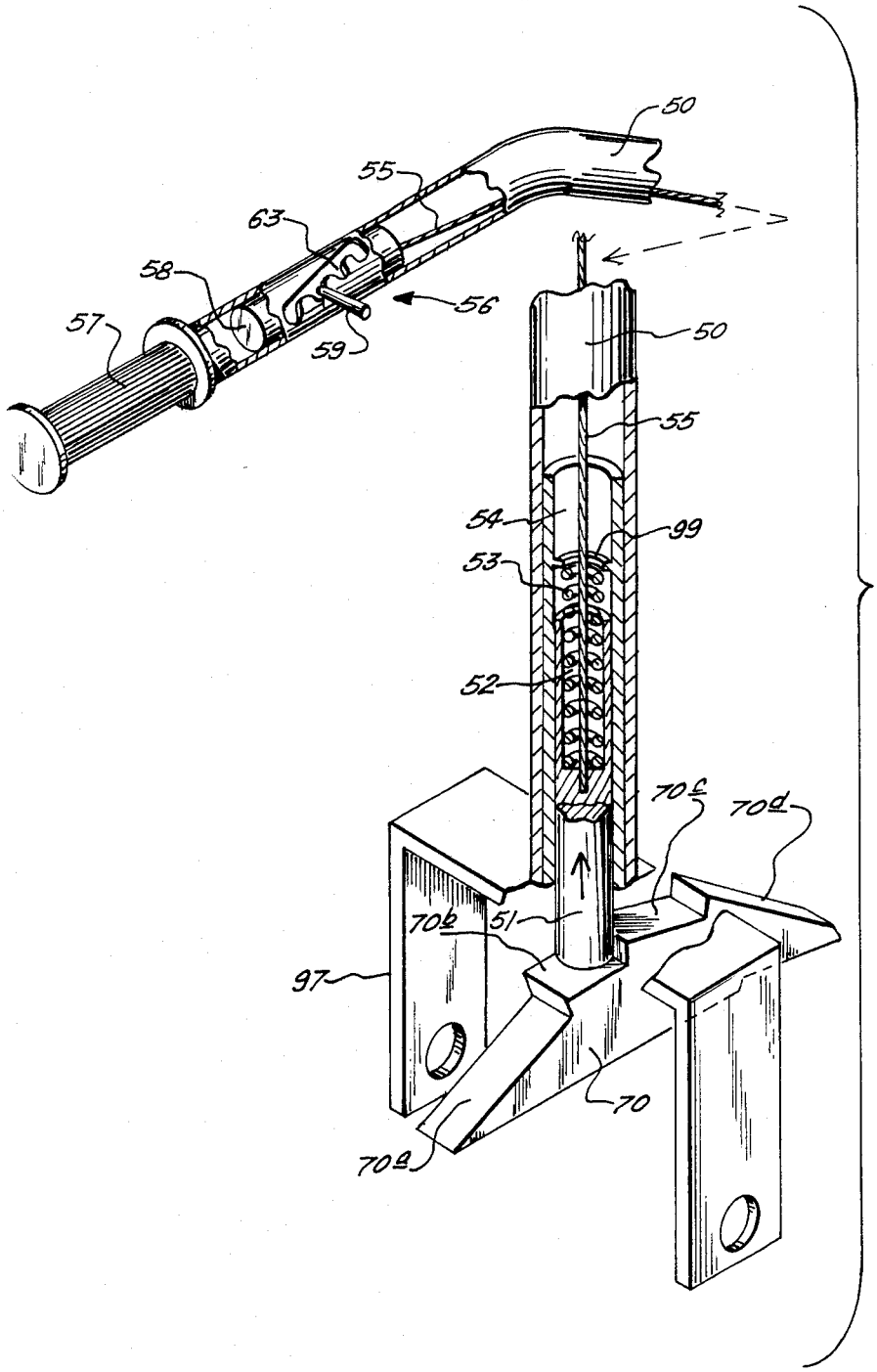
FIG. 6 is a view in perspective—partly broken away and partly in section—of a portion of the tillar arm and a portion of the latch and stop catch mechanism, including the release therefor.

Yet another feature of this invention, best seen in FIG. 6, is the unique latch and stop means that is employed in the preferred embodiments of this invention. While other suitable latch and stop systems may be employed, the system of FIG. 6 has the advantageous feature that it is additionally adapted to serve as a swivel joint. It will be seen from FIG. 6 that this preferred system comprises:

(a) a generally inverted "U"-shaped pivotable bracket 97 having a horizontal segment extending between a pair of upstanding segments, the horizontal segment having an aperture therein, the arm being rotatable about a horizontal axis extending laterally through the lower portions of the upstanding segments;

(b) a hollow cylindrical member (i.e., pivot pin 54) affixed to said horizontal segment so that the member is coaxial with and extends upwardly around said aperture;

(c) a cylindrical latch member (i.e., catch pin 51) coaxially aligned and slidable within said cylindrical member and extending downwardly through said aperture;

(d) a catch member 70 having a series of at least three linearly aligned stepped planar upper surfaces, the steps separating each planar upper surface from its adjacent upper planar surface, each of the outermost planar surfaces **70*a*, 70*d* being sloped downwardly away from its adjacent planar surface (70*b* and 70*c*, respectively) and the slope of each intervening planar surface (70*b* and 70*c*) being intermediate the slopes of its two adjacent planar surfaces, catch member 70 being disposed below and transverse to said horizontal segment so that as said bracket is pivoted about said axis, the base of latch member 51 linearly traverses said series of linearly aligned planar surfaces; and (e) means (e.g., spring 53) tending to force latch member 51 downwardly so that it abuts the upper planar surface of catch member 70 over which it is positioned by the pivotable bracket 97 and cylindrical member 54**.

As also shown in FIG. 6, it is particularly preferred that the elevation of the tops of said successive steps be progressively higher in one linear direction and progressively lower in the opposite direction. Thus the elevation of the top of the step (or riser) between planar surfaces **70*b* and 70*c* is higher than the elevation of the top of the step between planar surfaces 70*a* and 70*b*, but is lower than the elevation of the top of the step between planar surfaces 70*c* and 70*d*. The preferred system further includes means (e.g., cable 55 and latch or release 56) for pulling latch member 51 away from its abutted planar surface (70*b* in the position depicted in FIG. 6) so that bracket 97 is free to pivot on its horizontal axis. It will be noted that pivot pin 54 (the hollow cylindrical member) serves as a bearing around which tillar arm 50 can be rotated and against which forward and rearward force can be applied by tillar arm 50 to cause rotation or pivoting of bracket 97 around its horizontal axis. Thus pivot pin 54** is a focal point of the swivel action used in steering the boat and in adjusting the depth of propeller immersion to accommodate varying service conditions.

This invention should not be confused with drive trains for propeller shafts that make use of a series of Cardan constant velocity joints. These systems are used primarily in deep water operation in high performance boats. Such systems are massive and complicated in design, and require large, high-horsepower engines for satisfactory operation. And, such systems are quite expensive. All of these drawbacks are avoided by use of a system of this invention. Additionally, the systems of this invention offer the advantages referred to above—a combination of advantages that has not been available to the art until now.

It will also be noted the Drawings that unlike many prior mechanisms, the motor or engine 12 is mounted entirely within the perimeter of the boat 10. An advantage of mounting the engine in this manner and positioning the main power shaft 20 so that it and its enveloping transom tube 22 extend through the transom 14 is that this provides a propulsion and steering system having a low profile with essentially all mechanical parts (except tillar arm 50 and the parts associated therewith such as release 56) located below the level (i.e., below the top) of the transom. This facilitates use of the tillar arm and provides the operator a clearer view of the position of the propeller relative to the surface of the water and, in the case of shallow water operation, the bed underlying the water as well.

Besides affording the advantages referred to above, the systems of this invention have these additional advantageous features:

(a) The driving and steering mechanism operates from a single pivot point which is universal in movement.

Figure 3:
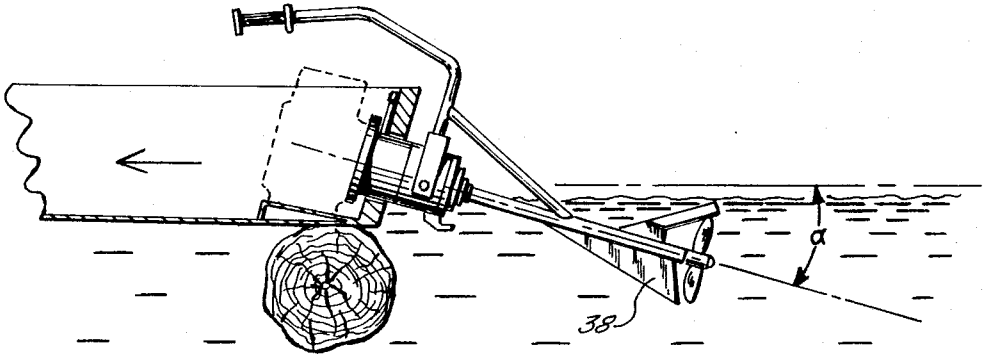
FIG. 3 is a side view illustrating a flat bottom boat being propelled in shallow water over a submerged obstruction, with the latch and stop catch means adjusted so that the propeller shaft and the main power shaft are linearly aligned (i.e., the vertical angle of displacement between them is 180 degrees) whereby the propeller shaft extends downwardly and rearwardly from the horizontal water surface at an acute angle.

(b) While the unit is in its normal drive position a minimum angle relative to the surface of the water may be achieved. (In the case of conventional flat bottom boats, angle alpha in FIG. 3 is preferably about 12 to 15 degrees). This in turn makes possible maintenance of minimum drag and draft of the system during use.

(c) The system is air-cooled thus allowing continuous operation under adverse conditions such as passage through mud or heavy vegetation, or the like.

(d) Steering and propeller depth are manually manipulated and controlled very easily.

(e) In the preferred systems, such as described above, total lubrication of all moving parts of the power drive train is accomplished simply and efficiently within a single closed system.

(f) In the preferred systems, such as described above, weeds or other vegetation do not become excessively entangled on the unit—such systems are virtually weed-proof in design and operation.

As this invention is susceptible of considerable variation, the forms and embodiments hereinbefore described being merely illustrative of preferred embodiments thereof, it is not intended that this invention be limited except within the spirit and scope of the following claims.

What is claimed is:

1. A mechanical system for steering and propelling power driven boats which comprises, in combination, a main power shaft, a propeller shaft, a housing for the propeller shaft, a disc-type constant velocity joint operatively connected to the propeller shaft, a coupling device connecting the disc type constant velocity joint to the main power shaft, a tube adapted to extend through the transom of the boat and encasing said coupling device and said constant velocity joint, a flexible boot having one large open end portion and one small open end portion, said large open end portion secured on the back exterior portion of said tube and said small open end portion secured on a forward exterior portion of said housing, said boot being adapted to retain within the tube and boot lubricating oil for said constant velocity joint, and tillar arm operatively connected to the housing of the propeller shaft.

2. The combination of claim 1 further including latch and stop means for adjusting the vertical angle of displacement between the propeller shaft and the main power shaft.

3. The combination of claim 2 in which said latch and stop means enable the propeller shaft to be aligned in a plurality of preselected vertical angular displacement positions relative to the power shaft.

4. The combination of claim 2 in which said latch and stop means are further characterized in that (a) they enable the propeller shaft to be aligned in a plurality of preselected vertical angular displacement positions relative to the power shaft, in that (b) they enable the propeller shaft, aligned in at least one of the preselected vertical angular displacement positions relative to the power shaft, to be moved laterally and upwardly but not downwardly from said preselected vertical angular displacement, and in that (c) they include a manually actuatable release enabling the propeller shaft to be moved upwardly or downwardly within the range of said preselected vertical angular displacement positions.

5. The combination of claim 2 in which said latch and stop means are further characterized in that they enable the propeller shaft, aligned in preselected vertical angular displacement relative to the power shaft, to be moved laterally for steering purposes while permitting the propeller shaft to be vertically displaced upwardly in the event the propeller shaft or the housing of the propeller comes in contact with a submerged obstacle.

6. The combination of claim 2 in which said latch and stop means are further characterized in that they enable the propeller shaft, aligned in preselected vertical angular displacement relative to the power shaft, to be moved laterally for steering purposes while permitting the propeller shaft to automatically be vertically displaced upwardly in the event and as soon as the propeller shaft or the housing of the propeller comes in contact with a submerged obstacle.

7. The combination of claim 1 further including means for adjusting the vertical angle of displacement between the propeller shaft and the main power shaft to thereby enable the propeller shaft to be aligned in a plurality of preselected vertical angular displacement positions relative to the power shaft.

8. The combination of claim 1 further including a prime mover mounted within the perimeter of a boat for rotating said power shaft, said power shaft extending through the transom of the boat.

9. The combination of claim 8 wherein the boat is a flat bottom boat.

10. The combination of claim 8 in which substantially all operating parts of said mechanical system with the exception of the tillar arm and parts associated therewith are positioned below the level of the transom of the boat.

11. A mechanical system for steering and propelling power driven boats which comprises, in combination, a main power shaft, a propeller shaft, a housing for the propeller shaft, a disc-type constant velocity joint operatively connected to the propeller shaft, a coupling device connecting the disc-type constant velocity joint to the main power shaft, and a tillar arm operatively connected to the housing of the propeller shaft, said coupling device comprising a hollow funnel-shaped body composed of (a) a cylindrical tubular section adapted to attachably receive an end portion of the power shaft, (b) an outwardly tapering conical section extending from said tubular section, (c) a wide ring-shaped mouth section extending from said conical section, the portion of the body forming said ring-shaped mouth section having an annular recess adapted to attachably receive the constant velocity joint, and (d) flute means extending from said conical section and adapted, when the device is rotated by the power shaft, to pick up lubricating oil and transmit lubricating oil into the interior of said conical section whereby centrifugal force from the rotation causes lubricating oil to travel along the interior of the conical section to lubricate the constant velocity joint from the interior of the device.

12. The combination of claim 11 further including latch and stop means for adjusting the vertical angle of displacement between the propeller shaft and the main power shaft.

13. The combination of claim 12 in which said latch and stop means are further characterized in that (a) they enable the propeller shaft to be aligned in a plurality of preselected vertical angular displacement positions relative to the power shaft, in that (b) they enable the propeller shaft, aligned in at least one of the preselected vertical angular displacement positions relative to the power shaft, to be moved laterally and upwardly but not downwardly from said preselected vertical angular displacement, and in that (c) they include a manually actuatable release enabling the propeller shaft to be moved upwardly or downwardly within the range of said preselected vertical angular displacement positions.

14. The combination of claim 11 further including a prime mover mounted within the perimeter of a boat for rotating said power shaft, said power shaft extending through the transom of the boat.

15. The combination of claim 14 wherein the boat is a flat bottom boat.

16. The combination of claim 15 in which substantially all operating parts of said mechanical system with the exception of the tillar arm and parts associated therewith are positioned below the level of the transom of the boat.

17. A coupling device especially adapted for connecting a disc-type constant velocity joint to a rotatable power shaft which comprises a hollow funnel-shaped body composed of (a) a cylindrical tubular section adapted to attachably receive an end portion of the power shaft, (b) an outwardly tapering conical section extending from said tubular section, (c) a wide ring-shaped mouth section extending from said conical section, the portion of the body forming said ring-shaped mouth section having an annular recess adapted to attachably receive the constant velocity joint, and (d) flute means extending from said conical section and adapted, when the device is rotated by the power shaft, to pick up lubricating oil and transmit lubricating oil into the interior of said conical section whereby centrifugal force from the rotation causes lubricating oil to travel along the interior of the conical section to lubricate the constant velocity joint from the interior of the device.

18. In combination, a coupling device of claim 17 and a disc-type constant velocity joint positioned within said recess and detachably attached to the coupling device.

19. A coupling device in accordance with claim 17 further characterized in that said cylindrical tubular section has an outer end portion and an inner end portion, said outer end portion having a larger diameter bore than the bore diameter of said inner end portion, said outer end portion being adapted to fit onto the end portion of the power shaft, and said inner end portion being adapted to coaxially accommodate means for threadably securing the device to the power shaft.

20. In combination, a power shaft, a coupling device of claim 19 and means threadably securing the coupling device to the power shaft.

21. The combination of claim 20 further including a disc-type constant velocity joint positioned within said recess and detachably attached to the coupling device.

22. A mechanical system for steering and propelling power driven boats which comprises, in combination, a main power shaft, a propeller shaft, a housing for the propeller shaft, a disc-type constant velocity joint operatively connecting the main power shaft and the propeller shaft, latch and stop means for adjusting the vertical angle of displacement between the propeller shaft and the main power shaft, and a tillar arm operatively connected to the housing of the propeller shaft, said latch and stop means comprising (a) a generally inverted "U"-shaped pivotable bracket having a horizontal segment extending between a pair of upstanding segments, the horizontal segment having an aperture therein, the arm being rotatable about a horizontal axis extending laterally through the lower portions of the upstanding segments;

(b) a hollow cylindrical member affixed to said horizontal segment so that the member is coaxial with and extends upwardly around said aperture;

(c) a cylindrical latch member coaxially aligned and slidable within said cylindrical member and extending downwardly through said aperture;

(d) a catch member having a series of at least three linearly aligned stepped planar upper surfaces, the steps separating each planar upper surface from its adjacent upper planar surface, each of the outermost planar surfaces being sloped downwardly away from its adjacent surface and the slope of each intervening planar surface being intermediate the slopes of its two adjacent planar surfaces, said catch member being disposed below and transverse to said horizontal segment so that as said bracket is pivoted about said axis, the base of said latch member linearly traverses said series of linearly aligned planar surfaces; and (e) means tending to force said latch member downwardly so that it abuts the upper planar surface of the catch member over which it is positioned by the pivotable bracket and cylindrical member.

23. A latch and stop means additionally adapted to serve as a swivel joint which comprises:

(a) a generally inverted "U"-shaped pivotable bracket having a horizontal segment extending between a pair of upstanding segments, the horizontal segment having an aperture therein, the arm being rotatable about a horizontal axis extending laterally through the lower portions of the upstanding segments;

(b) a hollow cylindrical member affixed to said horizontal segment so that the member is coaxial with and extends upwardly around said aperture;

(c) a cylindrical latch member coaxially aligned and slidable within said cylindrical member and extending downwardly through said aperture;

(d) a catch member having a series of at least three linearly aligned stepped planar upper surfaces, the steps separating each planar upper surface from its adjacent upper planar surface, each of the outermost planar surfaces being sloped downwardly away from its adjacent surface and the slope of each intervening planar surface being intermediate the slopes of its two adjacent planar surfaces, said catch member being disposed below and transverse to said horizontal segment so that as said bracket is pivoted about said axis, the base of said latch member linearly traverses said series of linearly aligned planar surfaces; and (e) means tending to force said latch member downwardly so that it abuts the upper planar surface of the catch member over which it is positioned by the pivotable bracket and cylindrical member.

24. The combination of claim 23 further characterized in that the elevation of the tops of said successive steps is progressively higher in one linear direction and progressively lower in the opposite direction.

25. The combination of claim 23 further including means for pulling said latch member away from its abutted planar surface so that said bracket is free to pivot on said axis.

* * * * *